United States Patent [19]

Hahn et al.

[11] 4,120,676

[45] Oct. 17, 1978

[54] METHOD AND APPARATUS FOR PRODUCING BLANKETS OF MINERAL FIBERS

[75] Inventors: William Peter Hahn, Somerville, N.J.; Edward Lee Hite, Toledo, Ohio; Donald Eugene Shisler, Defiance, Ohio; Charles Donald Simmers, Bowling Green, Ohio

[73] Assignee: Johns-Manville Corporation, Denver, Colo.

[21] Appl. No.: 236,372

[22] Filed: Mar. 20, 1972

[51] Int. Cl.[2] ..... C03B 37/04

[52] U.S. Cl. ..... 65/4 R; 65/5; 65/9; 65/16; 156/62.4; 264/112

[58] Field of Search ..... 65/4, 9, 11 R, 5, 16; 156/62.2, 62.4, 62.6, 62.8; 264/112

[56] References Cited

U.S. PATENT DOCUMENTS

| | | | |
|---|---|---|---|
| 2,565,941 | 8/1951 | Barnard | 65/4 |
| 2,961,698 | 11/1960 | Rea | 65/9 |
| 3,002,224 | 10/1961 | Stalego et al. | 65/9 |
| 3,769,115 | 10/1973 | Rasmussen et al. | 156/62.2 |
| 3,824,086 | 7/1974 | Perry et al. | 65/11 R X |

FOREIGN PATENT DOCUMENTS

| | | | |
|---|---|---|---|
| 599,084 | 3/1948 | United Kingdom | 264/112 |

*Primary Examiner*—Robert L. Lindsay, Jr.
*Attorney, Agent, or Firm*—Robert M. Krone; Joseph J. Kelly; John D. Lister

[57] ABSTRACT

A machine for forming mineral fibers into mats or blankets comprising a plurality of modules each including primary fiber formers, fiber attenuation means, binder applicators, and fiber collectors to produce continuous lengths of mat. A common conveyor is adapted to receive the mats of each module at spaced mat receiving stations along its length. The common conveyor receives the uncured mats in juxtaposition to each other and conveys them to stations for further processing. Each module is adapted to operate and be taken off or put on line without disruption of the operation of the other modules. Each includes a scrap conveyor for primary fibers, a fiber collection conveyor cleaning means for the conveyor and a suction box all of which are shielded from the common conveyor to avoid contamination of the mat on the common conveyor. Flexibility is afforded by the modules since combined fiber layers of different fiber characteristic, with different additives and binders, with interlayers or septa including septa which is gas impermeable, and in a wide range of densities and thickness can be produced on an in-line basis. Output can be split so that one or more modules are arranged to produce a mat for a first product while one or more other modules are producing a mat for a second product. A split, bidirectional common conveyor is utilized to optionally issue mat from one or both ends of the machine.

Fiber attenuation by gas blast is preferred for the modules and is arranged to direct the fibers vertically downward to a horizontal fiber collection conveyor at a low velocity and low enough temperature to avoid curing the binder for the fibers on the collection conveyor. A liquid reverse flush of the collection conveyor removes fibers and binder which adhere to the conveyor surface.

22 Claims, 3 Drawing Figures

METHOD AND APPARATUS FOR PRODUCING BLANKETS OF MINERAL FIBERS

BACKGROUND OF THE INVENTION

1. Field of the Invention

This invention relates to apparatus for the production of heat softenable materials and more particularly relates to apparatus for the production of felted mat or blankets of mineral fibers.

2. Discussion of the Prior Art

Heretofore blankets of mineral fibers have been produced by various techniques involving the formation and attenuation of fibers from a molten mass and the collection of those fibers, usually on a continuously moving foraminous belt in the form of an endless screen or chain surface. The attenuation of fibers has been accomplished by a rotary process wherein a molten stream of the material to be fiberized impinges upon a rotating surface and flows therefrom as fine fibers under the influence of centrifugal force and gas flow to a fiber collection conveyor. Rotary process fibers are relatively short and therefore less desirable for some applications than those fibers produced by gas attenuation. In the gas attenuation process filaments are exuded and/or drawn from a molten supply of materials and subjected to a high velocity gas blast to be attenuated. One technique involves drawing the material to solid filaments, primary filaments, and directing a gas blast of a temperature to remelt the filaments generally normal to the primary filament path of travel.

In both the rotary and gas blast processes of producing fibers the equipment required has been of a nature which severely limited the range of product which could efficiently be produced on a given machine. In general the past developments have been directed to means for producing fiber in quantities which could be incorporated in practical products at commercially acceptable rates and cost. R. H. Barnard U.S. Pat. No. 2,565,941 which issued Aug. 28, 1951 for "Method and Apparatus for Producing Laminated Materials" discloses a plurality of drawing chambers for producing glass fibers attenuated by the gas blast method. These fibers are collected in collecting chambers from which they issued and are laid down in succession on a conveyor. The output of the Barnard arrangement was limited since the quantity of fiber issued from each forming chamber under the impetus of gravity and the attenuating gas blast was quite limited.

Fiber output for the gas blast attenuated processes has been increased by utilizing a large number of fiber attenuators arranged to deposit the attenuated fibers on a collection conveyor on the opposite side of which negative pressure is maintained to draw the fibers to the collection conveyor. Forming tubes have been utilized to direct the fibers from their spaced attenuators to the more confined collection region as shown in Labino U.S. Pat. No. 3,076,236 for "Apparatus for Making Mats of Blown Mineral Fibers" which issued Feb. 5, 1963. Such process are limited by the effective fiber directing suction which can be maintained on the fiber receiving face of the collection conveyor as the fiber blanket builds since the blanket becomes an impediment to the gas flow which entrains the fibers.

One means of incresing the negative pressure where the entraining gas flow is restricted by previously deposited fibers is to provide separate suction boxes behind the fiber collection conveyor as in W. F. Rea U.S. Pat. No. 2,961,698 for "Process and Apparatus for Producing Fibrous Mats." In this arrangement a first fiber former has a collection chamber across the bottom of which is passed a fiber collection conveyor backed by a suction box. The fiber collection conveyor then advances the blanket to a position where a septum or reinforcement material is laid upon the blanket and then to a second fiber former having a separate collection chamber and suction box. While the second suction box can be controlled as to its negative pressure, the constraints of reduced pressure due to the impediment to gas flow of the previously deposited blanket and septum remain as limits on the fiber depositing capacity of the system.

Another form of apparatus for formation of composite fiber blanket is suggested in Slayter U.S. Pat. No. 2,457,784 wherein it is proposed that a plurality of mats be fed to a station where they are juxtaposed and manipulated to interfelt their fibers.

SUMMARY OF THE INVENTION

The present invention relates to the formation of blankets of mineral fibers. Apparatus for forming a plurality of blankets of mineral fibers includes means for attenuation of molten mineral fibers, means incorporating those fibers into a stream of entraining gas, and means for collecting those fibers in a collection chamber upon a collection conveyor. This apparatus avoids the constraint of the ultimate thickness or density of the blanket on gas flow through the blanket since discrete blanket portions can be formed in independent blanket forming modules and then combined in an in-line operation without adversely effecting those other discrete blanket portions formed for incorporation of the blanket products. Each uncured blanket portion can be formed with its own characteristics as to fiber composition and size, binder and additives. The components of the ultimate blanket are combined on a transfer conveyor extending adjacent the in-line oriented modules. Septa which are impervious to gas flow can be introduced between blanket portions and the blanket portions, and where desired, septa are juxtaposed at spaced blanket receiving stations on the transfer conveyor without the need to draw a flow of gas through the underlying material on the transfer conveyor.

More particularly, the illustrative embodiment discloses a five module machine for manufacture of glass fiber blanket or mat arranged to develop vertical streams of entraining gas and attenuated glass fibers in each module. The gas of the streams pass through a horizontal collecting conveyor to suction box below while fibers accumulate on the conveyor. All modules are aligned and their collection conveyors issue blankets of glass fibers at the same side of the respective modules and in the direction of alignment so they are released at spaced delivery stations to spaced mat receiving stations of a transfer conveyor extending beneath all modules. The lamination of the module blankets is accomplished by placing the blankets of successive modules on the juxtaposed blankets of preceding modules along the line orientation and travel of the transfer conveyor. The uncured resin binder of the several juxtaposed blankets binds them into a unitary blanket when the laminate is subjected to further processing.

Blanket modules are arranged for cooperation without interference with each other so that they each operate without adverse affects on the product of other modules by virtue of their orientation relative to each other. Shields prevent unwanted material from one module contacting portions of the blanket ultimately produced by the machine. Cleaning liquid is applied to the collecting conveyors of individual modules within shrouds or hoods which confine it and shields protect the partially assembled final blanket from fluid retained by the collecting conveyors after they leave the hood.

Individual modules can be shut down and started without interferring with machine production since the unattenuated primary fibers issued during such transistions are collected and removed from the modules by a scrap transfer system.

Each module can be arranged with multiple sections whereby sets of fiber formers, attenuators and forming tubes direct gas entrained fiber into a common forming chamber. Vertically drawn primary fibers are attenuated by generally horizontally directed hot gas blasts and the attenuted fibers and entraining gas are turned downward to a vertical flow path for collection in a blanket or mat on a generally horizontal collection conveyor. A suction box beneath the foraminous conveyor can be baffled and provided with suction means for the individual baffled sections arranged for greater negative pressure beneath that portion of the conveyor at the downstream end of the conveyor travel across the collection chamber, thereby insuring adequate gas flow through the greater thickness of fiber at that end.

As the collection conveyor carries the blanket from the collection chamber of each module it passes it to a delivery station above that module's blanket receiving station of the transfer conveyor. The transfer conveyor is divided into sections to lend flexibility to the machine whereby blankets requiring less than the output of all modules can be issued from both ends of the machine by reversing portions of the transfer conveyor. Utilization means such as curing ovens, presses, tube forming apparatus or other known apparatus for the processing of mineral fiber blankets containing uncured binder are located at the output end or ends of the transfer conveyor and receive the uncured blanket laminate for further processing.

DETAILED DESCRIPTION OF THE PREFERRED EMBODIMENT

Figure 1:
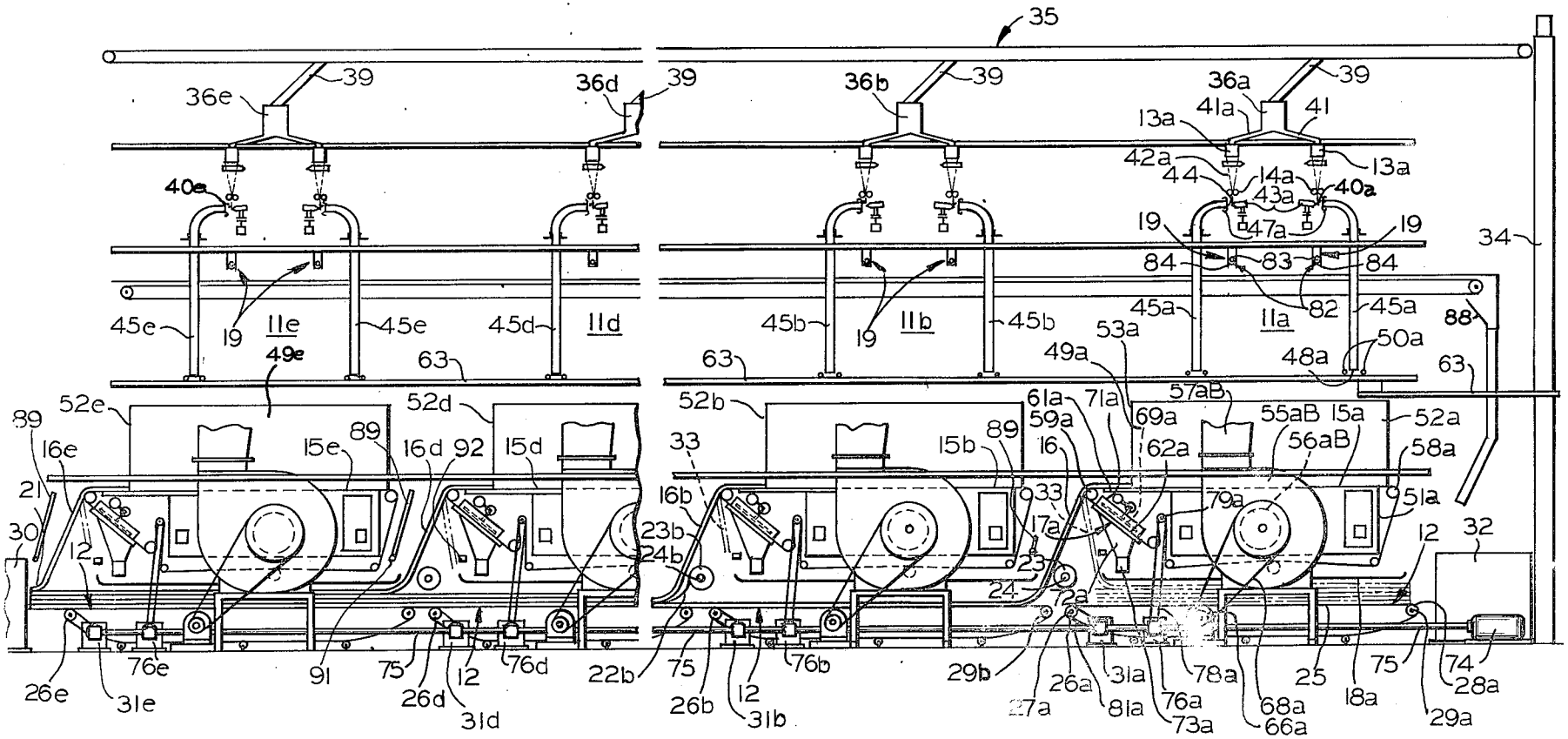
FIG. 1 is a side elevation of the apparatus according to this invention with portions broken away and support structural details eliminated to facilitate illustration of the invention.
Figure 2:
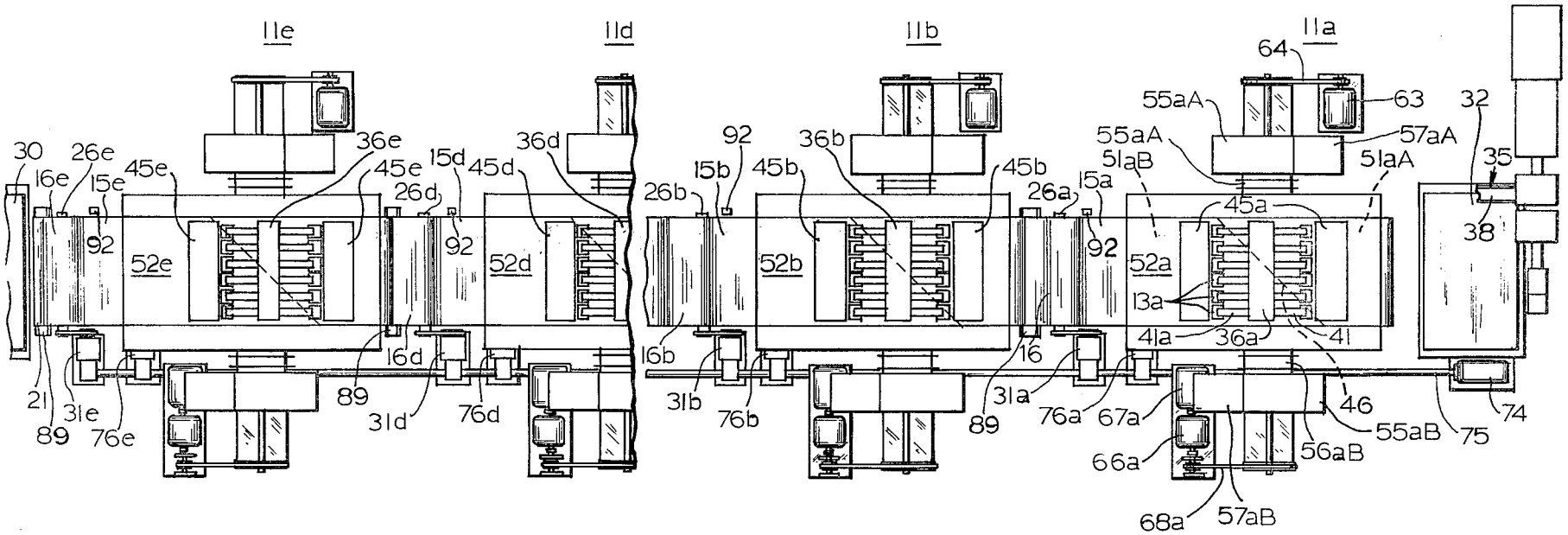
FIG. 2 is a plan view of the apparatus of FIG. 1.

FIG. 1 represents a machine according to this invention wherein a plurality of mat forming modules 11 are arranged in tandem and in convenient mat transfer relationship to a transfer conveyor 12 upon which several mats issuing from modules 11 can be juxtaposed. The modules and their elements will be designated by lower case letter suffixes where appropriate with five modules considered and identified from right to left in FIGS. 1 and 2 as *a* through *e*. Module 11*c* has been broken out of FIGS. 1 and 2 to facilitate illustration. Each module is made up of a fiber forming means 13 from which molten mineral fibers are exuded and drawn by pull rolls 14. In the example the fibers are of glass and are derived by melting bodies of glass such as marbles in pots 13 to which they are fed on a demand basis, i.e. as they are required to maintain a desired head of marbles and molten glass within the pots. However, it is to be appreciated that fiberizable minerals other than glass can be employed and the molten material can be supplied to the fiber formers from other sources such as flow channels from the forehearth of a furnace in which batch materials are melted and refined, all by means not shown.

All modules are of similar form. They are arranged to attenuate fibers and expose them to a binder during their transport to a collection conveyor 15. Advantageously, they are cooled and their velocity is reduced during their transport to the conveyor so that the binder does not cure to any significant degree on the collection conveyor and the fibers impinge upon the conveyor with passage into the conveyor interstices minimized. The mat or blanket 16 thus formed on the conveyor is passed to the transfer conveyor 12. Advantageously, the transfer conveyor is located below the modules 11 so that is passes uncured blanket 16 from preceding modules 11 beneath succeeding modules along the machine. Effective fiber collection is maintained by a liquid wash of the collection conveyor 15 at washer 17. The machine is operative with one or more modules shut down or held in a standby relationship in which primary fibers are issued but not attenuated as during transition from a running state to a shutdown state.

In order to maintain product quality, the tranfer conveyor is protected from contaminants from the modules by shields 18 and a primary fiber scrap collection system 19 conveys the fibers which are not attenuated to a suitable receptacle for reuse or other disposition.

Five modules are illustrated for the machine of FIG. 1. The machine is therefore adapted to produce a blanket or mat end product 21 issuing at its left end as viewed in FIG. 1 which has up to five layers of mat which can be of desired different types and amounts of fibers and different types and/or amounts of binder materials located through the thickness of the mat in any desired sequence or relative orientation. For example, if a product having coarse outer fibers and fine inner fibers is desired, modules *a* and *e* can be arranged to produce mat 16 of coarse fibers while one or more of modules *b*, *c* and *d* produce mat 16 of fine fibers. Further, the machine can be arranged for the introduction of other types of fibers or materials to be intermixed with the fibers being created either in a distribution of such fibers or materials as the mat 16 is formed in the individual modules 11 or as laminated structures with septa 22*b* between layers. These septa can be impermeable to gas since they are not interposed in the gas stream which entrains the fibers to transport them to the collection conveyor 15. Rather, they can be supplied from coils 23*b* mounted on and introduced from the shafts 24*b*.

Efficient utilization of the equipment embodied in the machine of the present invention dictates maximum flexibility in its operation. In addition to the variants available by control of individual module output and selective septa incorporation in the composite mat 21, the machine lends itself to split output wherein mat is issued from both ends. As shown in FIG. 1, each module of the machine can be provided with a section 25 of the transfer conveyor 12 having a turning roller 26 on a head shaft 27 and a turning roller 28 on a tail shaft 29 in conjunction with a bidirectional drive 31 coupled to the head shaft. The collection conveyor and transfer conveyor flight can be made up of chain links or wire mesh making continuous lengths of flexible screen surface. When all are driven in a direction to move the upper flight from right to left as viewed in FIG. 1, the composite product of all modules in operation issues an uncured mat 21 at the left. However, if a mat 21 requires less than the output of the five modules of the exemplary machine and if operable modules are available to the right of that module issuing the lowermost mat strata 16 to the transfer conveyor 12, then those available modules 11 can be employed to produce product simultaneously with the operation issuing mat 21 at the left. This is accomplished by reversal of the transfer conveyor section for the available modules so that their upper flights 25 are driven from left to right. Under such circumstances, with modules *c, d* and *e* contributing to mat 21 issuing to the left, the mat from modules *a* and *b* will follow the path shown in phantom as at 33 onto transfer conveyor sections 25 beneath modules *a* and *b* and issue at the rightmost turning roller 28*a*. Board forming equipment, tube forming equipment, forming presses or mat curing ovens, represented schematically as 30 and 32 at the left and right and ends of transfer convey 12, can be located at the issuing end or ends of transfer conveyor to receive and process the mat further in an in-line operation.

Compactness of the line is enhanced by the arrangement directing the flight of fibers in each module along a generally vertical path. Raw materials are admitted to each module from above and the fiber and resin binder in an uncured blanket form issue downwardly.

Figure 3:
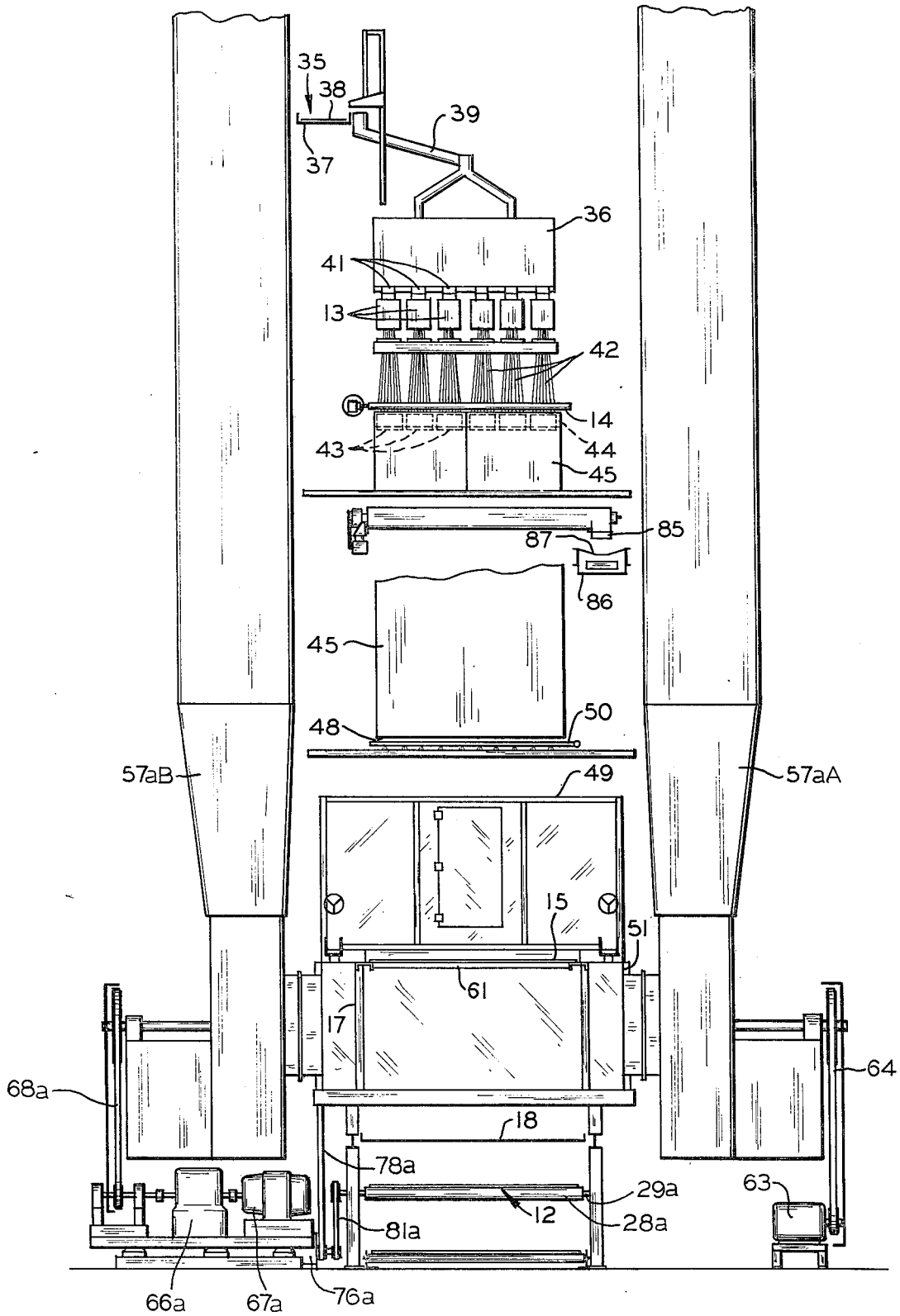
FIG. 3 is an end view of the appartus of FIG. 1 with portions removed to illustrate the blanket issuing end of a typical module with portions brokenn away to reveal details.

Glass marbles are supplied to the modules from a receptacle, not shown, feeding an elevator 34 which may be of the chain and bucket type. A marble conveyor 35 distributes the marbles to hoppers 36 each of which supplies the pots 13 of a module 11. Conveyor 35 can be of the form of a trough 37 having a continuous belt 38 on its bottom as best seen in FIG. 3 and having branched chutes 39 to direct marbles to spaced points of entry to hoppers 36. From the hopper 36, marbles are directed by individual chutes 41 to the pots 13 in which they are melted.

Primary filaments 42 of glass issue from orifices (not shown) in the bottom of pots 13 and are drawn by pull rolls 14 so they extend across the face of attenuation burners 43 which direct their high temperature effluent at a high velocity toward the open mouth 44 of forming tubes 45. A curtain of parallel, closely spaced primary filaments is thus developed across the width of the apparatus over a region generally corresponding to the width of the collecting conveyor 15 by passing them over a guide bar 40. The primaries are resoftened to drawing temperature in the burner effluent and are attenuated horizontally to fine fibers entrained in the effluent. Fiberization occurs in the first portion of travel of the effluent beyond the cantelevered primary filament ends and the fibers are solidified by ambient air inspirated by the motion energy of the burner effluent within a fraction of an inch of the filament ends.

The attenuated fibers and the entraining burner effluent are delivered to the mouth 44 of forming tube 45, of such opening size as to control the amount of air inspirated with a minimum of turbulance introduced into the blast stream. This relationship is based upon the burner capacity. Typically, a 1 million B.T.U. per hour burner 43 having an orifice ½ inch high and 8½ inches wide is accommodated by a forming tube mouth 7½ inches high and 14 to 16 inches wide spaced about 6 inches from the orifice.

The blast stream flow is enhanced for the typical grouping of six or seven burners 43 across a 96 inch forming tube 45 by fairings 47 in the form of a rolled lip. Laminar flow is retained while turning the effluent, inspirated air and entrained fiber from horizontal to vertical flow by maintaining the cross section of tube 45 around an inner radius of about 18 to 24 inches and by minimizing any back eddy effect at the tube exit 48 by a straight vertical section of a length of at least six times the radius of the inner curve.

The hot gas blast an entrained fiber discharge from tube 45 into a forming chamber 49 above the fiber collecting conveyor 15 and an underlying suction box 51. Binder is mixed into the stream as a liquid spray from headers 50 adjacent the forming tubes exits 48. In order to maximize exposure of the fiber to cooling ambient the exit 48 of tube 45 is located a substantial distance from the collection conveyor 15. Ambient air flow in chamber 49 is confined to that generally paralleling the hot gases. That is it is introduced along side the forming tube exit 48. A broad area is provided over the collecting conveyor for the withdrawal of air in order to afford a low velocity, high volume flow thereby enhancing the cooling off the fiber without subjecting it to mechanical working in turbulent gas streams. Advantageously, the lower lips of the upstream and downstream walls 52 and 53 of the forming chamber 49 are arranged in close proximity to the conveyor 15 and can be provided with seal rolls (not shown) at those apertures through which the continuous conveyor is passed to prevent ingress of air at the level of the conveyor. Air is impelled through the system by one or more fans 55 connected through ports 56 in the wall of suction box 51 to a suitable exhaust stack 57.

A chain form of conveyor 15 has been found effective wherein its upper flight is passed over rollers 58 and 59 and is supported in sliding relationship on a grill 61 above suction box 51. A blanket 16 of fiber is taken off conveyor 15 at a mat delivery station at roller 59 and the conveyor is passed through suitable cleaning apparatus 17 over a run 62 to remove adhering fiber and binder which may have been carried over from the blanket 16. It is then returned to roller 58 by a pass beneath suction box 51.

Free flow of ambient air is provided to the open top of the forming chamber 49. Thus, where catwalks 63 are provided they are formed of open gratings. If additives are to be incorporated in the blanket, they are introduced into the fiber stream from forming tubes 45 with apparatus (not shown) and techniques which minimize the diversion or disruption of the stream. Multiple forming tubes 45 are employed with construction of the stream of hot gas and fibers introduced at their entrances 44 minimized and with their exits disposed transverse of the direction of advance of conveyor 15 and spaced in that direction so that the streams are weighted toward the entry end of collection conveyor 15. This arrangement in conjunction with the restriction of air inspirated by the burner and tube design enables the flow of the effluent and fiber in a vertically downward direction with minimum tubulence and with the fiber in an open, free-flowing condition. Ambient air is introduced by the combined action of inspiration by the flow from forming tubes 45 and the suction on box 51.

During passage downward through chamber 49 the effluent and ambient air mix gradually and approach the same velocity with a minimum turbulence or mechanical action on the fiber. The fiber passes essentially in straight line flow to the conveyor with ambient air gradually mixed. Reduction of the temperature in the mat collected on conveyor 15 is enhanced by a binder spray as a curtain spray.

Two or more fiber forming sections can be employed to advantage where greater densities of fiber are to be collected. Such sections utilize the features of a uniform cross section forming tube as tubes 45 of FIG. 1. While the tubes can be arranged to feed individual forming chambers (not shown) with individual plenums, it has been found that by suitable spacing of the elements certain portions and the functions accomplished therein can be combined as by employing a common suction box 51 or a common forming chamber 49 in whole or in part. In multiple stage operations a substantial improvement in binder retention in the collected mat is realized in the later stages since the mat of the first and subsequent stages if any acts as an efficient filter for the binder entrained from the following fiber stream or streams.

The illustrated modules 11 are provided with a baffle 46 to divide the suction boxes into sections or chambers 51A and 51B and individual fans 55A and 55B for each chamber afford maximum flexibility of adjustment of the suction imposed on the felted mat of fibers as it builds. The forming chamber of this embodiment is common to an A and B stage forming tubes while the A and B suction boxes are in registry with the respective tubes along the path of flight of fibers to the collecting conveyor. In this arrangement the fan 55A for the A section is driven by motor 63 through a direct belt drive 64 and control of the vacuum drawn is by a damper (not shown) in the exhaust stack 57A. The B section fan 55B is driven through a variable speed drive 66 from motor 67 to belt drive 68 whereby a greater range of adjustment of the vacuum drawn is available.

In order to maintain control of fiber collection, the collecting surface or chain forming collecting conveyor 15 continuously is cleaned of fiber and binder. A rotating washer head 69 contained within an upper casing 71 directs a plurality of high velocity streams of liquid, which can be water where aqueous binders are used in the mat, against that surface of the collecting chain which was its underside during its travel across the bottom of the collecting chamber. The collecting chain is inverted at this time so that gravity augments the back flush of the sprayed liquid to carry the fibers and binders from the chain and into a collecting or drain hood 72 coupled to a suitable drain conduit 73 extending transverse of the machine module alignment to a suitable collecting means (not shown). Shield 18 protects the blanket on transfer conveyor 12 from cleaning liquid or debris which might drop from the washer unit 17 and the return flight of the conveyor chain 15.

Operation of collection conveyors 15 is matched to transfer conveyor 12 so that the speeds do not diverge and subject the blankets 16 to stress as they are passed from the conveyor 15 to conveyor 12 or between sections of conveyor 12. A main drive motor 74 of the variable speed type drives a line shaft 75 to takeoff stations for the several conveyors which comprise variable speed drives 76 for conveyors 15 and 31 for sections of conveyor 12. Where appropriate for reverse operation of sections of conveyor 12 drives 31 can incorporate selectively operable reversing means. Chain and sprocket couplings are provided between the drives 76 and 31 and drive shafts for the conveyors as chains 78 from drives 76 to drive roller 79 and chains 81 from drives 31 to drive rollers 26 of the sections of conveyor 12. The variable speed drives 76 and 31 afford means of trimming the surface speed of the conveyor flights to compensate for variations in the gearing, sprockets and drive chains whereby the desired relationships, usually uniform speed in all cooperating units, can be established and maintained.

The range of variation of the product of this apparatus can be appreciated from a consideration of the available variations. The number of blanket lamina incorporated in the final product is limited only by the number of modules 11 of the machine. While a single source of glass marbles for supplying all modules is shown, it is to be appreciated that different glass compositions can be fed to the hoppers 36 of the several modules to produce glass fibers having different compositions. The pull rate of the fibers and the attenuators can be adjusted to produce different fiber sizes from each module or even a blend of fiber sizes in the blanket from a single module as where the A and B sections of the fiber formers and attenuators are adjusted for such differences. Binder and additives can be changed from blanket to blanket by control of the supply to binder spray manifold 50 to each module of each module section. A mixture of septa can be introduced for such purposes as reinforcement, as a reflector of heat, and/or as a gas or vapor barrier.

During shutdown and start up of modules a quantity of primary fibers are produced which are not of the quality required for controlled attenuation. These primaries are disposed of without disruption of other modules or the blanket passing beneath the module generating them by permitting them to drop into a trough 82 below the fiber forming pots 13. An auger conveyor 83 is fitted into the semi-cylindrical bottom 84 of trough 82 to advance scrap primary filaments to a chute 85. From chute 85 the scrap is deposited on a belt 87 formed as a trough within casing 86. The belt is driven to carry the scrap to a discharge chute 88 from which it is deposited in a suitable receptacle not shown.

The blanket 16 produced during the period the primary fibers are being positioned in a suitable array across guide bar 40 and the attenuation burners are placed in operation is frequently of inferior quality. Such blanket 16 is excluded from the transfer conveyor 12 and the blankets thereon which make up the composite product 21 by a door 89 which is pivoted at 91 so that it can be shifted to rest on stop 92 and intercept the out of standard blanket 16 on its travel from the blanket issuing station of conveyor 15 to the blanket receiving station of transfer conveyor 12. The blanket intercepted by door 89 is removed from between the modules 11 by suitable means or manually. When the curtain 42 of primary fibers has been formed, when the attenuation burners have been brought up to their proper output, and when the blanket issuing from collection conveyor 15 meets stanndards the door 89 is pivoted around its pivot 91 to the position illustrated for each module in FIGS. 1 and 2 to clear the path between the issuing and receiving stations.

While the arrangement of in-line fiber blanket forming modules each having its own suction box, and each requiring suction of the fiber stream through only the blanket developed in its module is particulrly advantageous for the production of thick high density blankets, or blankets with septa forming gas barriers, where the fiber stream is vertical and the lamination of blanket portions is on a horizontal conveyor from horizontal collection conveyors, it is to be understood that the machine can be modified without departing from its spirit. Thus, the fiber can be attenuated by the rotary process rather than by gas blast attenuation. Fiber collection can be on an essentially vertical flight of a collection conveyor. The transfer conveyor can be located other than below the blanket forming modules. However, the hot gas attenuation with laminar flow maximized produces superior staple fibers in that they are longer and less abraded as deposited on the collection screen and thus result in a stronger blanket. Further, the vertical flow through the open faced collection chamber reduces fiber velocity to increase the cooling in flight so that the blanket temperature does not rise to the cure temperature of the binder and the low velocity of impingement of fibers on the collectin conveyor minimizes fiber penetration into the conveyor interstices. While collection conveyor cleaning by other than washing techniques might be employed, the thorough cleaning afforded by washing enhances control and thus blanket quality significantly. Accordingly, it is to be understood that the preferred embodiment disclosed lends itself to modifications within the concept of this invention and therefore is to be read as illustrative of the invention and not in a limiting sense.

What is claimed is:

1. Apparatus for the production of mineral fiber mats comprising a plurality of mat forming modules arranged in an in-line orientation; fiber issuing means for each module comprising means for making mineral fibers from molten mineral material; a forming chamber for each of said modules; means for directing said fibers toward said forming chamber and means for cooling said fibers; a mat delivery station for each of said modules; a fiber collecting conveyor for each of said modules in said forming chamber and having a foraminous fiber receiving surface adapted to collect fiber in mat form in said forming chamber and to convey said mat in the direction of said in-line orientation from said forming chamber to said mat delivery station; means for applying binder to said fibers before said fibers are conveyed from said forming chamber to said mat delivery station; a suction box in communication with said forming chamber through said fiber collecting conveyor; said mat delivery stations of respective modules being spaced apart in said in-line orientation; and a transfer conveyor located beneath said delivery stations and arranged to advance horizontally adjacent a plurality of said spaced delivery stations in the direction of said in-line orientation and adapted to receive mat from the individual delivery stations at spaced locations along said conveyor and each of said delivery stations including means for superposing said mat on said transfer conveyor or on the mat delivered from at least one preceding delivery station.

2. Apparatus according to claim 1 wherein said directing means for each of a plurality of said modules includes a tube for directing said fiber in a generally vertical direction and downward into said forming chamber.

3. Apparatus according to claim 1 wherein said fiber issuing means includes means issuing primary fibers along a path in a generally downwardly direction at a greater height than said forming chamber for each of a plurality of said modules; a gas blast attenuator for each issuing means directed generally normal to the fiber issuing path of said issuing means for attenuating said primary fibers to staple fibers for each of a plurality of said modules; and said directing means includes a forming tube for each module having an entrance aperture opposite said gas blast attenuator and said primary fiber path, said tube being turned downward to a generally vertical direction.

4. Apparatus according to claim 1 including shield means for said transfer conveyor between said transfer conveyor and each of a plurality of said modules; and mat receiving stations for said transfer conveyor between said shield means of respective modules.

5. Apparatus according to claim 1 including shield means above said transfer conveyor and below at least one of said modules.

6. Apparatus for the production of mineral fiber mats comprising a plurality of mat forming modules arranged in an in-line orientation; fiber issuing means for each module; a forming chamber for each of said modules; a mat delivery station for each of said modules; a fiber collecting conveyor for each of said modules in said forming chamber and having a foraminous fiber receiving surface adapted to collect fiber in mat form in said forming chamber and to convey said mat from said forming chamber to said mat delivery station; a cleaning station for said fiber collecting conveyor for each of said modules adapted to clean said conveyor as its collecting surface increments are transferred from said mat delivery station to said forming chamber; a suction box in communication with said forming chamber through said fiber collecting conveyor; said mat delivery stations of respective modules being spaced apart in said in-line orientation; and a transfer conveyor arranged to advance adjacent a plurality of said spaced delivery stations in the direction of said in-line orientation and adapted to receive mat from the individual delivery stations at spaced locations along said conveyor and each of said delivery stations including means for superposing said mat on said transfer conveyor or on the mat delivered from at least one preceding delivery station.

7. Apparatus according to claim 6 wherein said cleaning station applies a washing liquid to said fiber collecting conveyor; and including a shield between said cleaning station, its respective fiber collecting conveyor and said transfer conveyor.

8. Apparatus according to claim 7 wherein said collecting conveyor has a run in said cleaning station having a horizontal component and having the fiber collecting surface of said conveyor facing downward; and wherein said cleaning station includes a liquid spray means above said run of said collecting conveyor and directed toward the surface of said conveyor opposite said fiber collecting surface.

9. Apparatus according to claim 8 including a spray hood enclosing said spray means and said run of said conveyor in said cleaning station.

10. Apparatus according to claim 1 drive means for said fiber collecting conveyor for each module, drive means for said transfer conveyor, and means to adjust the surface speeds of said transfer conveyor and said fiber collecting conveyors with respect to each other.

11. Apparatus according to claim 1 including a trough extending beneath said fiber issuing means of at least one module and adapted to receive fiber from said issuing means; and drive means for displacing fiber in said trough from the vicinity of said collecting conveyor and said transfer conveyor.

12. Apparatus according to claim 1 including a septum supply means for at least one of said modules located between said mat delivery station of said one module and said transfer conveyor adapted to introduce a septum between a first blanket of fiber on said transfer conveyor and a blanket of fiber from said one module.

13. Apparatus for the production of mineral fiber mats comprising a plurality of mat forming modules arranged in an in-line orientation; fiber issuing means for each module; a forming chamber for each of said modules; a mat delivery station for each of said modules; a fiber collecting conveyor for each of said modules in said forming chamber and having a foraminous fiber receiving surface adapted to collect fiber in mat form in said forming chamber and to convey said mat from said forming chamber to said mat delivery station; a suction box in communication with said forming chamber through said fiber collecting conveyor; said mat delivery stations of respective modules being spaced apart in said in-line orientation; a transfer conveyor arranged to advance adjacent a plurality of said spaced delivery stations in the direction of said in-line orientation and adapted to receive mat from the individual delivery stations at spaced locations along said conveyor and each of said delivery stations including means for superposing said mat on said transfer conveyor or on the mat delivered from at least one preceding delivery station; and for each of said modules mat intercepting means adapted to be selectively located between said mat delivery station of said module and said transfer conveyor and adapted to intercept the mat of fiber from said module and prevent its deposition for displacement by said transfer conveyor.

14. Apparatus for the production of mineral fiber mats comprising a plurality of mat forming modules arranged in an in-line orientation; fiber issuing means for each module; a forming chamber for each of said modules; a mat delivery station for each of said modules; a fiber collecting conveyor for each of said modules in said forming chamber and having a foraminous fiber receiving surface adapted to collect fiber in mat form in said forming chamber and to convey said mat from said forming chamber to said mat delivery station; a suction box in communication with said forming chamber through said fiber collecting conveyor; said mat delivery stations of respective modules being spaced apart in said in-line orientation; and a transfer conveyor arranged to advance beneath and adjacent a plurality of said spaced delivery stations in the direction of said in-line orientation and adapted to receive mat from the individual delivery stations at spaced locations along said conveyor and each of said delivery stations including means for superposing said mat on said transfer conveyor or on the mat delivered from at least one preceding delivery station and said transfer conveyor having at least two independent sections including selectively reversible drive means for one of said sections.

15. Method for the production of mineral fiber mats by means of a plurality of mat forming modules arranged in an in-line orientation comprising: making mineral fibers from molten mineral material or each module; directing said fibers toward a forming chamber and cooling said fibers; applying binder to said fibers in said forming chamber; collecting said fiber on collecting conveyors in said forming chamber of each of said modules by drawing air through foraminous fiber receiving surfaces of said conveyors to assist in collection; conveying said mats in the direction of said in-line orientation from said forming chambers to mat delivery stations which are spaced apart in said in-line orientation; locating a transfer conveyor beneath said delivery stations; moving said transfer conveyor horizontally adjacent a plurality of said spaced delivery stations and in the direction of said in-line orientation; depositing said mats on said transfer conveyor in superposed relationship; and curing the binder in said mats.

16. In an apparatus for processing fine fibers formed from heat softened viscous thermoplastic mineral material, such as glass, said apparatus comprising a plurality of fiberizing units positioned in series and in line, and in which each of said fiberizing units comprises means for producing fine fibers from heat softened thermoplastic mineral material, means for impregnating the fibrous mass with binder material, collection conveyor means positioned below said fiberizing unit for collecting said fine fibers, the improvement comprising a section of open foraminous collection conveyor means under each of a plurality of said fiberizing units, said collection conveyor means having means to collect the fine fibers produced by each said fiberizing unit in individual fibrous blanket form, and said plurality of fiberizing units having means for separating the fibrous blanket formed by each unit from any other, and driving means for said collection conveyor means, and combining conveyor means to receive and to combine said individual fibrous blanket forms from said fiberizing units into a thicker fibrous blanket.

17. Apparatus according to claim 16 in which there is a section of open foraminous collection conveyor means under each of said fiberizing units, said collection conveyor means having means to collect the fine fibers produced by each said fiberizing unit in individual fibrous blanket form, and said fiberizing units having means for separating the fibrous blanket of each unit from any other, and driving means for said collection conveyor means, and combining conveyor means to receive and to combine individual fibrous blanket forms from said collection conveyor means into a thicker fibrous blanket.

18. In an apparatus for processing fine fibers formed from heat softened viscous thermoplastic mineral material, such as glass, said apparatus comprising a plurality of fiberizing units positioned in series and in line, and in which each of said fiberizing units comprises means for producing fine fibers from heat softened thermoplastic mineral material, means for impregnating the fibrous mass with binder material, collection conveyor means positioned below said fiberizing unit for collecting said fine fibers, the improvement comprising a plurality of individual endless foraminous collection conveyor means positioned under a plurality of said fiberizing units in said line, each said endless collection conveyor means comprising a top pass travelling under at least one fiberizing unit to collect the fine fibers produced by said fiberizing unit in fibrous blanket form, and a bottom pass returning to the starting point of said endless conveyor travel, and combining conveyor means positioned at the discharge points of said individual collection conveyor means to receive and to combine the fibrous blankets discharged from said individual collection conveyor means into a thicker fibrous blanket.

19. Apparatus according to claim 18 in which there is an individual endless foraminous collection conveyor means positioned under each of said fiberizing units in said line, each said endless collection conveyor means comprising a top pass travelling under one fiberizing unit to collect the fine fibers produced by said fiberizing unit . . . in fibrous blanket form, and a bottom pass returning to the starting point of said endless conveyor travel, and combining conveyor means positioned at the discharge points of said individual collection conveyor means to receive and to combine the fibrous blankets discharged from said individual collection conveyor means into a thicker fibrous blanket.

20. Apparatus according to claim 18 in which said combining conveyor means to combine the fibrous blankets discharged from said individual collection conveyor means into a plurality of thicker fibrous blankets.

21. In an apparatus for processing fine fibers formed from heat softened viscous thermoplastic mineral material, such as glass, said apparatus comprising a plurality of fiberizing units positioned in series and in line, and in which each of said fiberizing units comprises, means for producing fine fibers from heat softened thermoplastic mineral material, means for impregnating the fibrous mass with binder material, collection conveyor means positioned below said fiberizing unit for collecting said fine fibers, the improvement comprising a section of open foraminous collection conveyor means under each of a plurality of said fiberizing units, and which said section is substantially free of a veil of fibrous material formed by a fiberizing unit positioned ahead of said section in said line and combining conveyor means to receive and to combine individual fiberous blanket forms from said collection conveyor means into a thicker fibrous blanket.

22. Apparatus according to claim 21 in which there is a section of open foraminous collection conveyor means under each of said fiberizing units in said line, and which said section is substantially free of veil of fibrous material formed by a fiberizing unit positioned ahead of said section in said line, and combining conveyor means to receive and to combine individual fibrous blanket forms from said collection conveyor means into a thicker fibrous blanket.

* * * * *